United States Patent [19]

Hammond

[11] 4,346,784

[45] Aug. 31, 1982

[54] KNEE SUPPORT APPARATUS

[76] Inventor: William E. Hammond, 17330 Saticoy, Van Nuys, Calif. 91406

[21] Appl. No.: 153,027

[22] Filed: May 27, 1980

[51] Int. Cl.[3] ..... A47C 7/50

[52] U.S. Cl. ..... 182/230; 2/24

[58] Field of Search ..... 2/22, 24, 62; 182/230; 297/423, 438, 439; D2/24; D6/2

[56] References Cited

U.S. PATENT DOCUMENTS

| | | | |
|---|---|---|---|
| D. 255,281 | 6/1980 | Breitenstine | 2/24 X |
| 2,195,817 | 4/1940 | Johnson | 2/24 |
| 2,627,301 | 12/1953 | Emmett | 182/230 |
| 2,719,576 | 10/1955 | Emmett | 182/230 |
| 3,112,812 | 12/1963 | Ramon | 182/230 |
| 3,499,502 | 3/1970 | Rosander | 182/230 |
| 3,544,054 | 12/1970 | Ward | 182/230 |
| 4,043,424 | 8/1977 | Crain | 182/230 |

*Primary Examiner*—Robert Mackey
*Attorney, Agent, or Firm*—Roger A. Marrs

[57] ABSTRACT

A knee support apparatus is disclosed herein for supporting a workman on an area of freshly laid cement or concrete during a procedure of smoothing the surface thereof. The apparatus comprises a pair of identical knee supports wherein each support includes an elongated base member having an undersurface movably resting on the cement or concrete surface and a top surface carrying a cushion. A metal frame having a central opening is employed for securing the edge marginal region of the cushion to the base member so that the bulb of the cushion material is exposed through the central opening thereof. A knee and a foot member upwardly projects from the base member on which a soft roller is attached. The foot member is adjustable longitudinally so as to accommodate different users.

5 Claims, 3 Drawing Figures

KNEE SUPPORT APPARATUS

BACKGROUND OF THE INVENTION

1. Field of the Invention

This invention relates to the field of supports for workmen and more particularly to a novel knee support apparatus adapted to carry the weight of a workman on a cement or concrete area while the workman is smoothing and finishing the surface thereof.

2. Description of the Prior Art

In the construction industry, it is common practice to smooth and finish the surface of freshly laid cement or concrete by trowelling the surface by hand. It is difficult for the workman to reach or extend his body over the freshly laid cement or concrete without stepping, standing or kneeling in the cement itself while the trowel is worked to finish the surface. As the procedure continues, the workman moves rearwardly until his body is out of the work area and the final surface has been thoroughly smoothed.

Difficulties and problems have been encountered when employing this conventional procedure which stem largely from the fact that the workman becomes covered with the fresh cement or concrete and rather large depressions or holes are formed in the work area as the workman moves rearwardly. Filling and covering such depressions or holes are time consuming and sometimes require the additional pouring of cement to fill the deficiencies.

Therefore, a long standing need has existed to provide a suitable support system or apparatus capable of carrying the weight of the workman which will not disrupt the work area of freshly laid cement or concrete and which will adequately disburse the weight of the workman over a larger area so that holes and depression do not develop.

SUMMARY OF THE INVENTION

Accordingly, the above problems and difficulties are obviated by the present invention which provides a novel knee support apparatus including a pair of knee supports wherein each support includes an elongated base member having an undersurface adapted to slidably engage with the surface intended to be finished and having a top surface on which a suitable cushioning means is carried. An elongated frame having a central opening is employed for securing the edge marginal regions of the cushioning means to the top surface of the base member so that the bulk of the cushion material projects upwardly through the central opening of the frame. The base member further supports a knee support member and a foot support member wherein each support comprises a pair of upright stanchions supporting a soft roller between the ends thereof. The knee support is intended to engage with the users leg immediately above the knee while his foot is engaged with the roller of the foot support. Adjusting means are provided for separating the foot support from the knee support in order to accommodate users of different sizes.

Therefore, it is among the primary objects of the present invention to provide a novel knee support apparatus for workmen finishing the surface of an area of freshly laid cement or concrete which will support the weight of the user and distribute the weight over a larger area than would normally be contacted were the supports not used.

Another object of the present invention is to provide a novel apparatus for supporting the weight of a workman in finishing the surface of freshly laid cement or concrete which will readily fit between the knee of the user and his foot and which includes adjustment means for varying the distance between a knee and a foot support.

Still another object of the present invention is to provide a novel knee support apparatus which evenly distributes a workmans weight over a large area of surface so that depressions, holes or the like are not left in the work area.

A further object of the present invention is to provide an economical and inexpensive support for carrying the weight of a workman so that a freshly laid area of cement or concrete may be properly trowelled without leaving depressions or holes in the concrete or cement.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF THE PREFERRED EMBODIMENT

Figure 1:
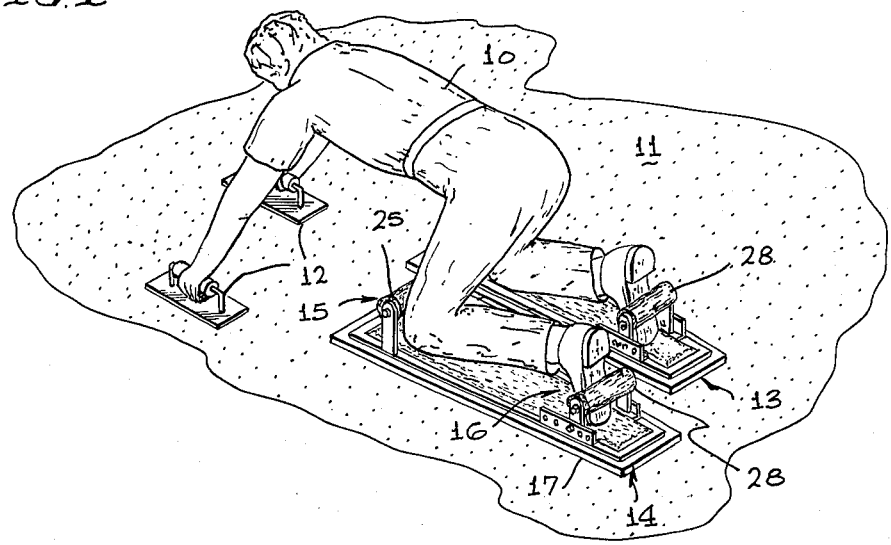
FIG. 1 is a perspective view of a typical workman employing the knee support apparatus of the present invention while trowelling the surface of a work area.

Referring now to FIG. 1, a workman illustrated by numeral 10 is shown performing a surface smoothing procedure on an area 11 of fresh cement or concrete. In the performance of the procedure, it is customary for the workman to use one or two trowels 12 and to move the trowel in a circular direction to smooth the surface. In performing the procedure using the present invention, the workman is using the knee support apparatus of the present invention which includes knee supports 13 and 14. The knee supports are associated with each leg of the workman and evenly distributes his weight over an area substantially greater than would otherwise be distributed without the apparatus. It is noted that each of the knee supports 13 and 14 include front knee support 15 and a rear foot support indicated in the direction of arrow 16. The knee support and foot support are carried on a base member 17.

Figure 2:
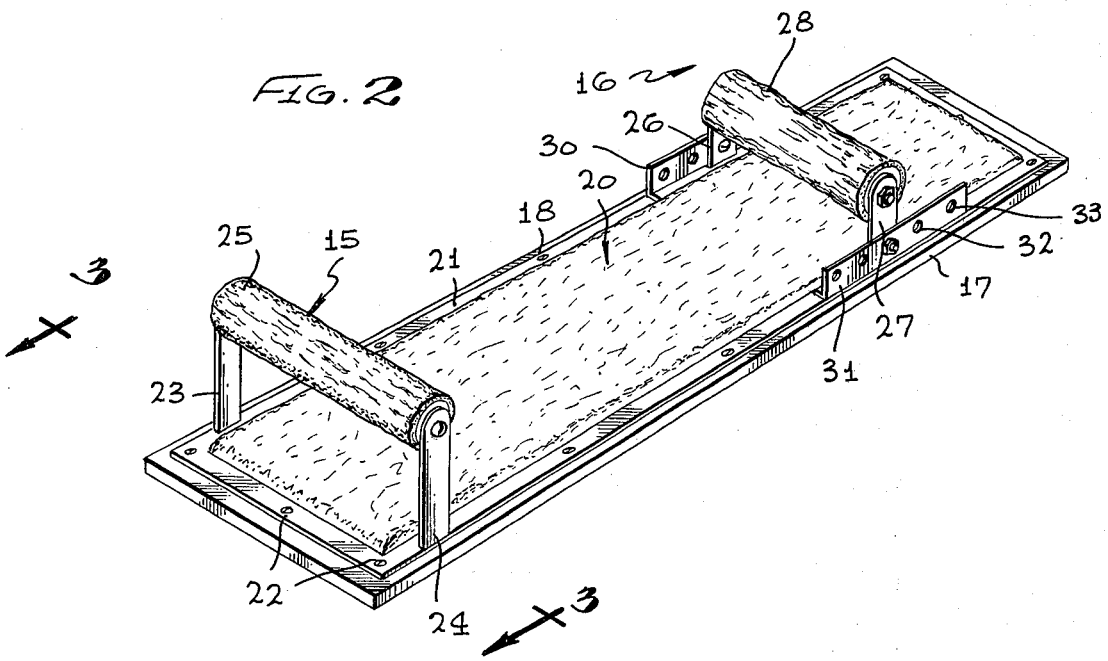
FIG. 2 is a perspective view of the knee support included in the apparatus shown in FIG. 1.

With respect to FIG. 2, the knee support is shown more clearly and it can be seen that the base support or member 17 includes an undersurface which is intended to engage with the work surface intended to be smooth. The member 17 further includes a top surface 18 which carries a quantity of cushion material indicated in general by numeral 20. The edge marginal regions of the cushion material 20 are held to the top surface 18 of the member 17 by means of a frame 21 having a central opening through which the bulk of the cushion material projects. A plurality of screws or nails may be employed for securing the frame to the member 17 so as to hold down the edge marginal regions of the cushion material. Such nails or screws are indicated in general by the numeral 22. The cushion means or material 20 may be of any suitable soft or pliable material which will suitably cushion the knees and foot of the workman.

FIG. 2 also illustrates that the front support 15 includes a pair of upright brackets 23 and 24 which are arranged in fixed spaced apart relationship on the base member 17 near one end thereof and which rotatably support a soft roller 25 between the opposing surfaces of the free ends. The soft roller is intended to be engaged by the leg of the user immediately above the knee substantially as shown in FIG. 1.

At the rear or opposite end of the base member 17, there is provided a second set of upright brackets 26 and 27 which rotatably support a soft roller 28. Adjustment means are provided for longitudinally moving the foot support back and forth to adjust the length of the users leg which includes a pair of flanged braces 30 and 31 located on opposite sides of the base member 17. Each of the flanged braces 30 and 31 include a series of spaced apart holes such as hole 32 and 33 which insertably receive a suitable fastener when registered with a similar hole in the lower end of its associated brace 27. Therefore, the distance between the front knee support 15 and the rear foot support may be adjusted to accommodate the user.

Figure 3:
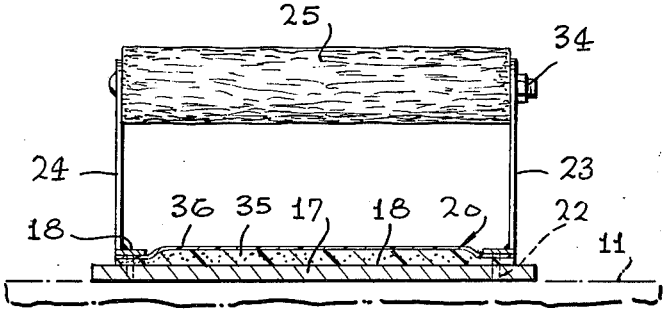
FIG. 3 is a transverse cross-sectional view of the knee support shown in FIG. 2 as taken in the direction of arrows 3—3 thereof.

Referring now in detail to FIG. 3, it can be seen that the roller 25 is carried between the opposing surfaces of the braces or brackets 23 and 24 by means of a nut and screw arrangement identified by numeral 34. It can also be seen in FIG. 3 that the cushion material 20 includes a soft inter-material 35 which is covered by a suitable tough liner 36. The frame 21 also is secured to the base of each bracket 23 and 24 to further retain the brackets in place on the base 17.

In actual operation, the knee support apparatus of the present invention in placed on the surface of the cement or concrete area intended to be smooth. The workman places his knees against the front knee support 15 on each member and places his feet against the rear rollers 28. He may now move over the area 11 and while moving can trowel and smooth the surface. Upon completion, the workman may readily withdraw his legs from the apparatus and pick them up from the surface.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What I claim is:

1. Knee support apparatus comprising:

an elongated base member having an undersurface slidably engagable with a soft working surface;

cushion means carried on a top surface of said base member;

a front knee support means including a pair of spaced apart upright brackets secured to one end of said base member and a soft roller movably carried between the ends of said brackets; and a rear foot support means including a pair of spaced apart upright brackets secured to the other end of said base member and a soft roller movably carried between the ends of said brackets.

2. The invention as defined in claim 1 including;

means for adjusting the distance between said front knee support means and said rear foot support means.

3. The invention as defined in claim 2 wherein:

said adjusting means includes a pair of braces having a series of holes therein adapted to register with a hole in one of said brackets and a fastener insertable through said registered holes for securement.

4. The invention as defined in claim 3 including:

means for securing said cushion means to said base member top surface.

5. The invention as defined in claim 4 wherein:

said last mentioned means includes a frame having a central opening engagable with the edge marginal region of said cushion means; and fastener means securing said frame and said cushion edge marginal region to said base member.

* * * * *